US005895080A

United States Patent [19]

Drumheller

[11] Patent Number: 5,895,080

[45] Date of Patent: Apr. 20, 1999

[54] ADDITIONAL SECURITY, APPLICATION, AND OPERABILITY IN CHILD-RESISTANT LATCHES

[76] Inventor: Kirk Drumheller, 5015 Nicklas Pl. NE, Seattle, Wash. 98105

[21] Appl. No.: 08/828,362

[22] Filed: Mar. 28, 1997

Related U.S. Application Data

[ 60] Provisional application No. 60/014,602, Mar. 29, 1996.

[51] Int. Cl.[6] ..... E05C 3/04

[52] U.S. Cl. ..... 292/202; 292/DIG. 63; 292/DIG. 65

[58] Field of Search ..... 292/DIG. 63, DIG. 65, 292/202; 312/204, 209

[56] References Cited

U.S. PATENT DOCUMENTS

| | | | |
|---|---|---|---|
| 1,152,404 | 9/1915 | Eldridge . | |
| 1,346,566 | 7/1920 | Stamm | 292/DIG. 63 |
| 1,828,698 | 10/1931 | Berry . | |
| 2,233,699 | 3/1941 | Gorrell . | |
| 3,084,965 | 4/1963 | Carosello . | |
| 3,109,900 | 11/1963 | Van Hook . | |
| 3,115,269 | 12/1963 | Rasmussen | 292/DIG. 65 |
| 3,780,547 | 12/1973 | Drumheller . | |
| 3,999,792 | 12/1976 | Smith . | |
| 4,286,809 | 9/1981 | Godwin . | |
| 4,416,477 | 11/1983 | Bialobrzeski et al. . | |
| 4,607,455 | 8/1986 | Bluem et al. . | |
| 4,677,791 | 7/1987 | Larson et al. . | |
| 4,715,628 | 12/1987 | Brink et al. . | |
| 4,854,448 | 8/1989 | Hair . | |
| 5,033,634 | 7/1991 | Batchelor et al. . | |
| 5,199,753 | 4/1993 | Presley, Jr. . | |
| 5,217,265 | 6/1993 | Lerner et al. . | |
| 5,267,668 | 12/1993 | Jones . | |

FOREIGN PATENT DOCUMENTS

| | | |
|---|---|---|
| 88922 | 3/1960 | Denmark . |

*Primary Examiner*—Flemming Saether

[57] ABSTRACT

Improvements in child-resistant latches which require adult length fingers to operated include a spring loaded movable shield covering the finger hole and separating the inside from the outside of the cabinet so items in the cabinet are not accessible through the finger entry hole, a variable length finger passageway which can be changed without jeopardizing the basic security of the cabinet, and means of clarifying operating instructions by identifying the inside location of the latch operating lever on the outside of the door.

4 Claims, 2 Drawing Sheets

ADDITIONAL SECURITY, APPLICATION, AND OPERABILITY IN CHILD-RESISTANT LATCHES

This application claims benefit of Provisional Application Ser. No. 60/014,602, filed Mar. 29, 1996.

BACKGROUND—FIELD OF INVENTION

This invention relates to child-resistant latches which require, for operation, a finger longer than the longest finger of a normal child of four years of age or less.

BACKGROUND—DESCRIPTION OF PRIOR ART

Child-resistant latches which depend on adult length fingers for their operation have been in existence for over twenty years.

Prior art devices utilizing the finger length principle include:

U.S. Pat. No. 1,152,404, Eldridge

U.S. Pat. No. 1,828,698, Berry

U.S. Pat. No. 2,233,699, Gorrell

U.S. Pat. No. 3,109,900, Van Hook

U.S. Pat. No. 3,084,965, Carosello

U.S. Pat. No. 3,780,547, Drumheller

Danish Patent No. 88,922, Rasmussen

Latches of this type, when properly applied and used, are among the most difficult for children under four years of age to operate and among the easiest for normal adults of all ages to operate.

The principle of operation is that a covered passageway from the outside of the container being protected to the latch on the inside is longer than that which can be traversed by any finger of most children under four years of age. In practice, the finger passageway is curved so the latch can not be readily operated by a stick or a hooked device.

One problem with latches of this type is that, when used in a small cabinet, it may be possible for a child to pick up the cabinet and shake it in such a way that small objects within the cabinet can be shaken through the finger hole. The referenced invention by Berry provides protection against shaking out the contents through the finger hole. However, the Berry invention addresses only the secure storage of matches. It requires a separate movable drawer. The movable drawer system is not as convenient or practical as a cabinet with a door, for the storage of most materials.

Another problem with latches of this type is that people are of greatly varying sizes. The tallest person in one family may be five feet high, with corresponding finger lengths. The tallest person in another family may be seven feet high, with corresponding finger lengths. In a family composed of small people, the finger passageway length for an adult may be such that it could be traversed by a child in a family of very large people. For child-resistant cabinets utilizing the finger length principle it is thus desirable to provide for adjustment in the finger path length. This has been done commercially by providing a cabinet in which the latch can be moved relative to the finger hole, thus increasing the length of the passageway. One problem with this method is that the latch has to be removed and replaced. If the person who does the removing and replacing is unskilled or careless, the latch can be removed and improperly reinstalled, thus potentially reducing the security of the cabinet.

One of the recent changes in the U.S. Consumer Product Safety Commission requirements for child-resistant packaging is that the packaging be more readily opened by adults. This change has been instituted because if packages are difficult to open and close, adults may just leave them open, thereby eliminating the child-resistant quality in the packaging. Child-resistant latches which depend on adult length fingers for operation are generally easy for adults to operate once the adult understands the system. However, it often takes some time to figure out the system, since the operating part of the latch is inside the cabinet where the person can not see it.

SUMMARY AND OBJECTIVES OF THE INVENTION

Objects and advantages of the child-resistant latches described in the above referenced patents are recognized. Additional objects and advantages of the present invention are; in child-resistant cabinets which rely on finger length for their child-resistance:

a. To provide an internal shield which prevents small objects inside the cabinet from reaching the outside through the finger hole. This prevents a child from picking up the cabinet and shaking small materials such as pills out of the cabinet through the finger hole.

b. To provide a method of adjusting the length of the finger pathway that does not completely jeopardize the security of the cabinet. This protects against an inept or careless person completely destroying the security of the cabinet by taking off the latch to relocate it, and failing to reinstall it properly.

c. To simplify operation of the latch by providing means of identifying, on the outside of the cabinet, the location of the latch operating lever on the inside of the cabinet so persons operating the cabinet for the first time can understand where they must apply pressure on the inside to open the cabinet. While cabinets which do not serve as a package for goods being sold are not required to meet the standards of the U.S. Consumer Product Safety Commission, it is still desirable to have the features of being resistant to children but easily opened by adults. These simplified instructions can be particularly helpful to people who order child-resistant cabinets through the mail.

It is noted that any of the above objects of my invention can be achieved independent of the others.

Further objects and advantages of my invention will become apparent from a consideration of the drawings and ensuing description.

DRAWING FIGURES

REFERENCE NUMERALS IN DRAWING

Figure 1:
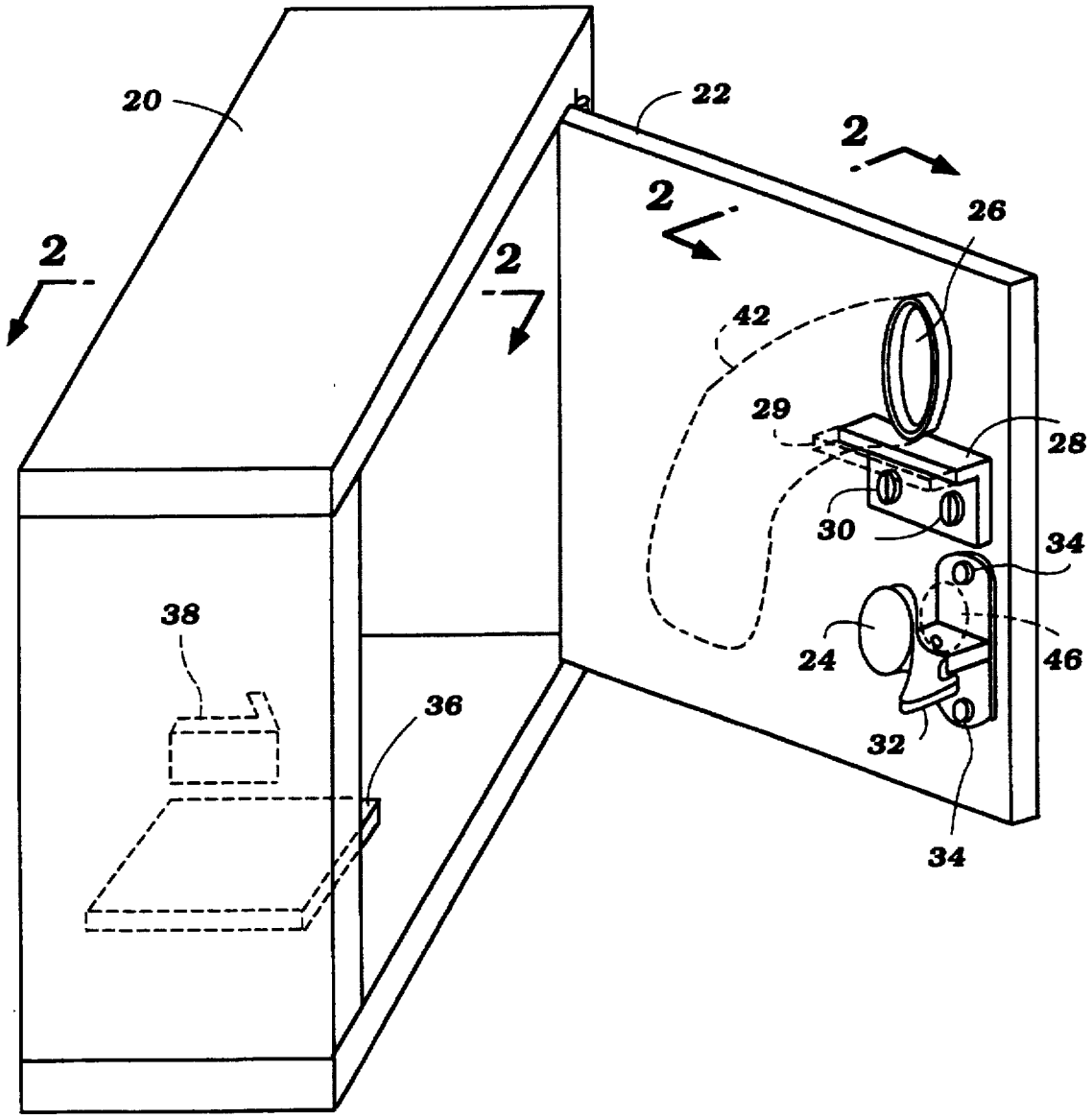
FIG. 1 is a perspective view of a cabinet with the door open.

20 cabinet
22 door
24 latch operating lever
26 finger hole
28 extender
29 longer extender
30 extender fastener screw
32 latch
36 shield
38 latch strike

40 slanted shield floor
42 glove finger shield
44 trap door shield
46 locating mark

DESCRIPTION OF PREFERRED EMBODIMENT a. Internal Shield

Figure 2:
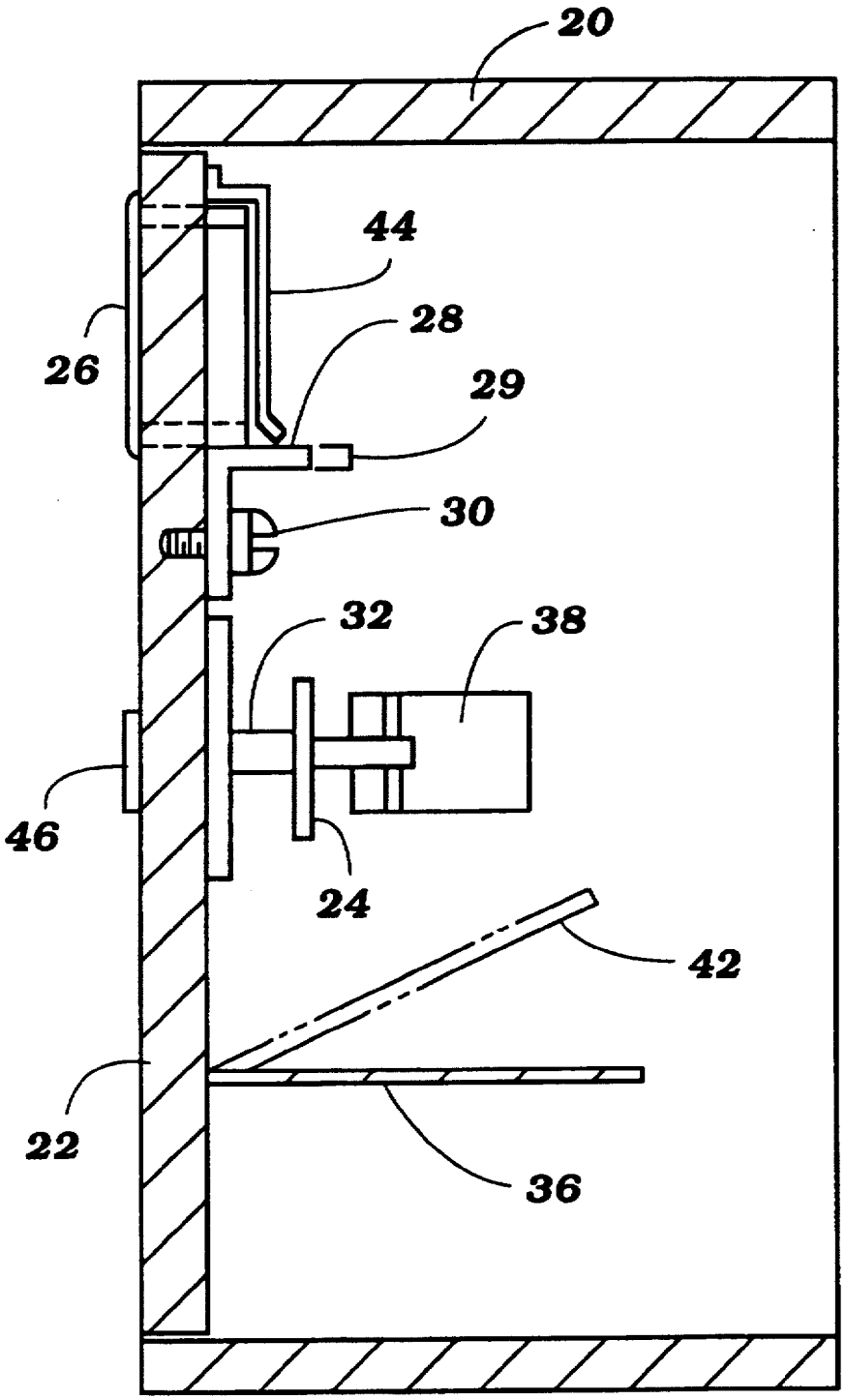
FIG. 2 is a section through section 2—2 of the cabinet of FIG. 1.

Typical embodiments of the shield to prevent small items from reaching the outside of the cabinet improperly through the finger hole are shown in FIGS. 1 and 2. A cabinet 20 has a door 22 hinged at one side and latched at the opposite side. Access from the outside of the cabinet to the latch operating lever 24 is provided by a passageway from the outside of the cabinet, through the finger hole 26, over the extender 28 to the latch operating lever 24. The finger hole 26 is only large enough to allow for the comfortable insertion of the largest finger of a large adult. The purpose of the extender 28 is to lengthen and complicate the finger pathway. The extender 28 is attached to the door by extender fastener screws 30 or other removable means. The latch 32 is permanently attached to the door with rivets 34 or other permanent fastening means. A shield 36 is attached to the cabinet 20. The shield 36 prevents items from being stored in the cabinet 20 in such a way that the finger passageway is blocked when the door 22 is closed, thus making entry of a finger difficult or impossible. In FIG. 1 the shield 36 is illustrated with a horizontal floor. The floor can be tilted as indicated by the dotted line 42 in FIG. 2 so articles can not be easily stored there.

A flexible shield 42 is illustrated in FIG. 1. This shield 42 is attached to the door 22 and completely covers the finger hole 26. The shield 42 is flexible like the finger of a glove, allowing a finger to pass through the finger hole 26 and operate the operating lever 24. The shield 42 is of a material that will prevent material from being moved from the inside of the cabinet 20 to the outside.

A trap door shield 44 is illustrated in FIG. 2. This trap door shield 44 can be moved away from the finger hole 26 by a finger so the finger can move through the passageway and operate the operating lever 24, and snaps back into place when the finger is removed.

b. Variable-Length Finger Passageway

An embodiment of the variable length finger passageway is illustrated in FIGS. 1 and 2. The extender 28 serves to both lengthen the passageway for the operating finger and make the passageway curved to prevent operation by a simple stick. The extender is attached to the door by screws 30 or other removable means. The extender fastener screws 30 are on the inside so they can not be removed when the cabinet door 22 is closed. The finger passageway is lengthened by removing the extender 28 and replacing it with an extender 29 of greater length. The passageway is shortened by replacing the extender 28 with a shorter length extender.

c. Simplified Operating Instructions

An embodiment of the simplified instruction approach is illustrated in FIGS. 1, 2, and 7. A locating mark 60 is placed on the outside of the cabinet door 22 (FIGS. 1 and 2), and 70 (FIG. 7) directly opposite the latch operating lever 24 on the inside of the cabinet door 22 and 70. Instructions provided with the cabinet say, for example, "Note the distinctive mark. The latch release is beneath this mark on the other side of the door. Insert finger in the hole and bend toward the mark. Press on the latch release and pull to open the door." With the locating mark 60 in place, these instructions are very easy to follow and difficult to misinterpret.

OPERATION a. Internal Shield

The manner of using the latch is the same as that with existing child-resistant latches which utilize the difference in length in children's fingers and adult fingers for security. The finger is inserted through the finger hole 26 and follows the passageway past the extender 28 to the latch operating lever 24. The latch operating lever 24 is pressed to release the latch 32 and allow the cabinet door 22 to be opened. The shield 42 or 44 is provided, as needed, to prevent shaking small items out of the cabinet 20 through the finger hole 26.

b. Variable-Length Finger Passageway

The finger passageway length is adjusted by removing the extender fastener screws 30 from the door 22, removing the extender 28, and replacing the extender 28 with an extender 29 of a different length.

c. Simplified Operating Instructions

To use the simplified instruction and locating mark 46, the potential user reads the instructions, which say, for example "Note the distinctive mark on the outside of the cabinet door about one and a half inches below the bottom edge of the finger hole. The latch release lever is beneath this mark on the other side of the door. Insert finger in the hole and bend toward the mark. Press on the latch release and pull to open the door."

SUMMARY, RAMIFICATIONS AND SCOPE

Latches which require an adult size finger for operation are among the most child-resistant available. They are also more easily operated by adults than some closures. However, they can provide a hole to the space outside the cabinet through which small pieces can pass. Particularly in small cabinets which a child may be able to pick up and shake, pills which are loose inside may be made accessible to the child. Since, even with adult friendly closures, adults may occasionally leave the caps off of medicines, the shield enclosure which makes the outside inaccessible to small pills provides a significant increase in safety.

Providing adjustment in the finger passageway in such a way that the user can easily adjust the length without jeopardizing the basic security of the cabinet expands the market for child-resistant cabinets by making such cabinets available to families comprised of physically small, medium sized, or very large people.

The identification of the inside location of the latch operating lever by indicating the location on the outside of the cabinet greatly improves the ease with which operating instructions can be understood. The explicit, simple instruction is expected to significantly expand the market for devices of this type by making it easier for persons viewing a point of sale display to operate a demonstration unit and making mail order cabinets more quickly operable.

Thus the scope of the invention should be determined by the appended claims and their legal equivalents, rather than by the examples given.

I claim:

1. A child-resistant latching apparatus on a door having an inside surface and outside surface, said door being mounted within a frame for movement of one door edge toward or away from a stationary frame member during closing or opening of the door, comprising:

a movable latch mounted to the inside surface of the door adjacent said one door edge;

a keeper mounted to said frame member in the path of the latch during movement of the door relative to the frame member for locking engagement of the latch and keeper in response to closing of the door;

said latch including a manually operable device for releasing the latch from engagement with the keeper in response to finger pressure thereon;

a finger entry hole formed through the door alongside the latch for access to the latch through the outside surface of the door;

inwardly projecting dog means on the inside surface of the door intermediate the finger entry hole and manually operable device of said latch for providing an obstacle to finger access to said latch so that the manually operable device cannot be reached through the entry hole by a person having fingers of a length less than a predetermined minimum length;

and a distinguishing mark applied to the outside surface of the door, directly opposite the operating lever pressure point of the manually operable device for releasing the latch on the inside of the door, precisely identifying on the outside of the door the point at which pressure must be applied to release the latch, thereby making possible the preparation of precise instructions for operation of the latch.

2. A child-resistant latching apparatus according to claim 1 further comprising:

attaching means securing the inwardly projecting dog means to the inside surface of the door, said attaching means having one component attached to the door and another component which fastens the dog to this component and the door, said attaching means being capable of removal and reattachment with hand operated tools, said attaching means being such that the dog means can be removed and replaced with a dog of a different configuration, thereby changing the length of finger required for operability of the latch through the hole.

3. A child-resistant latching apparatus according to claim 1 further comprising:

a cover attached moveably to the inside surface of the door and completely covering the finger hole; thereby preventing articles stored in the cabinet from being passed from inside the cabinet to the outside through the finger hole.

4. A child-resistant latching apparatus according to claim 1 further comprising:

a flexible cover mounted on the inside of the finger hole and completely covering the finger hole, said flexible cover being of size and shape that a finger can pass through the finger hole in the cover to the operating lever of the latch, such that items can not be moved from inside the cabinet to the outside through the finger hole.

* * * * *